US006435884B1

(12) United States Patent
Tada

(10) Patent No.: US 6,435,884 B1
(45) Date of Patent: Aug. 20, 2002

(54) TWO-WIRE TYPE WIRING CASE

(75) Inventor: Kiyoshi Tada, Tokyo (JP)

(73) Assignee: AIOI Systems, Co., Ltd., Tokyo (JP)

( * ) Notice: Subject to any disclaimer, the term of this patent is extended or adjusted under 35 U.S.C. 154(b) by 0 days.

(21) Appl. No.: 09/899,720

(22) Filed: Jul. 5, 2001

(30) Foreign Application Priority Data

Jul. 7, 2000 (JP) ..... 2000-206820

(51) Int. Cl.[7] ..... H01R 25/00
(52) U.S. Cl. ..... 439/110; 439/94
(58) Field of Search ..... 439/110, 111, 439/94, 115, 116

(56) References Cited

U.S. PATENT DOCUMENTS 4,031,317 A * 6/1977 McClain et al. ..... 327/12
5,348,485 A 9/1994 Briechle et al. ..... 439/110
5,748,714 A * 5/1998 Yoshida ..... 358/438
6,012,244 A 1/2000 Begum et al. ..... 40/661.03

FOREIGN PATENT DOCUMENTS

EP 0 821 449 1/1998
JP 101 773 53 6/1998

* cited by examiner

*Primary Examiner*—Tulsidas Patel
(74) *Attorney, Agent, or Firm*—Bachman & Ls Pointe, P.C.

(57) ABSTRACT

The wiring case has a detachable display device for displaying contents of data and electric transmission/reception communications established with a predetermined controlling device. In the display device, a pair of wiring members are prepared. The tip end portions of the wiring members are directed towards the bottom surface portion of the wiring case, and the each tip end portion has a contact point. The wiring case has an opening at a section opposing to the bottom surface portion, and a stopper portion is formed at end portion of each of sidewalls of the long-scale box.

7 Claims, 7 Drawing Sheets

TWO-WIRE TYPE WIRING CASE

CROSS-REFERENCE TO RELATED APPLICATIONS

This application is based upon and claims the benefit of priority from the prior Japanese Patent Application No. 2000-206820, filed Jul. 7, 2000, the entire contents of which are incorporated herein by reference.

BACKGROUND OF THE INVENTION

1. Field of the Invention

The present invention relates to a wiring case for housing a plurality of receiving devices (devices to be controlled) such that each of which can establish data and electric communications with a transmitter device (control device) via two power lines.

2. Description of the Related Art

Conventionally, a two-wire type data and electric transmission/reception communication system is known as a technique for carrying out data and electric transmission/reception communication which is conducted with use of two power lines (that is, a technique for carrying out transmission/reception of power (electricity) and data communication at the same time) (cf. Japanese Patent No. 27887976). In this system, one transmitter-side device and a plurality of receiver-side devices are connected together via two power lines. While a power which contains data component is transmitted from the electric transmitter device, the electrical charge and data decoding are carried out on the side of a receiver device. When the electrical transmission is stopped in the transmitter side, the receiver device a power containing data addressed to the transmitter device is sent on the basis of the charged power. In this manner, the transmission/reception communication of electrical power and data can be carried out between one and n-number devices with a less amount of wiring.

In some cases of the actual application of such a two-wire data and electric transmission/reception communication system, the number of receiver devices becomes 20 to 30 or even more, or the site where a receiver device is mounted must be charged from one place to another frequently. Under these circumstances, it is very important to carry out the wiring operation for connecting the transmitter device and the receiver devices with each other at high efficiency. In view of increasing the efficiency of the wiring operation, it is effective to use a wiring duct base as discussed in Japanese Patent Application KOKAI Publication No. Hei10-177353.

Such a wiring duct base has a substrate portion and engagement portions formed along both sides of the substrate, and has a flat-plate shape in which at least two tape-like conductive members for transmitting electrical signals are provided on the surface of the substrate along its longitudinal direction. A receiver device is formed into a unit (display unit), and a conductive member electrically connected to the receiver device is provided on the rear surface side of the unit, with stopper portions being formed at both end sides. As the stopper portions engage with the engagement portions of the wiring duct base, the display unit is mounted on the front surface of the wiring duct base. As it is mounted, the conductive member located at the rear surface section of the display unit is brought into contact with the tape-like conductive member to be electrically connected thereto. The strength of the engagement of the stopper portions and engagement portions between the display unit and the wiring duct base is set such that the strength on one end is looser than that of the other end, and the display unit is detached from the wiring duct base from the looser engagement end.

With the wiring duct base having the above-described structure, the display unit can be mounted at an arbitrary position. Further, since the wiring has been provided in advance, a further wiring operation is not required when replacing the unit.

In the two-wire data and electric transmission/reception communication, generally, a large-capacity power is allowed to flow in a conductive member. Therefore, a pair of conductive members must be kept away from each other by a certain distance or more so that mutual interference, that is, one conductive member being interfered with the power of the other one, can be avoided. Further, the conductivity of each conductive plate is determined by a product of its cross sectional area and surface dimension (cross sectional area x surface dimension), and therefore when the conductivity is lowered, the decrease in voltage is lessened accordingly.

However, the conventional wiring duct base has engagement portions formed at both ends, and therefore there is a certain limit to the area in which conductive plates can be installed. In the case where it is possible to assure a sufficient width of a section where a wiring unit is mounted (that is, the width of the wiring unit), there will be no problem since the width of the wiring unit can be increased. However, in the case where it is not possible, the cross sectional area and surface dimension of each conductive plate cannot be increased, and therefore it becomes difficult to mount such a great number of display units.

Further, the conventional wiring duct base has engagement portions on its both sides, and the display unit has stopper portions. With this structure, it requires a great force to detach a display unit from the wiring duct base, which results in a poor operability in replacement of the unit.

SUMMARY OF THE INVENTION

The present invention has been proposed to solve the above-described drawback of the conventional technique, and its object is to provide a wiring case having an excellent operability, which can assure a sufficient size of conducting members and an interval between conductive members.

According to a first aspect of the present invention, there is provided a two-wire type wiring case for mounting a device to be controlled, which establishes data and electric transmission/reception communication with a predetermined controller, the device having a front surface portion provided thereon with an electronic circuit operable by the data and electric transmission/reception communication, side portions provided thereon with respective elastic engagement mechanisms, and a rear surface provided thereon with a pair of projecting portions each having at a tip end thereof a first conductivity member electrically connected to the electronic circuit, the wiring case comprising: a long-scale mount portion for detachably mounting the device, the long-scale mount portion comprising: a pair of second conductivity members provided in a band-like arrangement in a longitudinal direction at positions which are respectively contactable with the pair of first conductivity members, the pair of second conductivity members having a gap provided therebetween for avoiding an interference of one of the second conductivity members, the interference being otherwise caused due to power flowing through the other of the second conductivity members when the pair of second conductivity members are energized; and fixation mechanisms provided at positions remote from the pair of second conductivity members, for detachably fixing the device, by engaging with the respective elastic engagement mechanisms, wherein the pair of first conductivity members are brought into contact with the second conductivity members respectively when the device is mounted onto the wiring case so that data and electric transmission/reception communication between the mounted device and the controller is established when the second conductivity members are electrically connected to the controller.

As described, the fixation mechanisms of the long-scale mount portion are formed at side end portions thereof so that they are located as far away as possible from the second conductivity members. With this structure, the width of each second conductivity member and the distance between second conductivity members (conductive plates) can be widened as compared to the case the fixation mechanisms are formed near the second conductivity members. As the width of each second conductivity member can be increased, the conductivity of the second conductivity member is increased, thus making it possible to suppress the drop of voltage. In this manner, it is possible to increase the number of devices, which can be installed.

It may be arranged that the long-scale mount portion has a shape of substantially U in a cross section perpendicular to the longitudinal direction, and the pair of second conductivity members are provided on an inner bottom surface of the long-scale mount portion.

With this structure, the area of the bottom surface portion, which is defined by one end in the longitudinal direction and the other side, can be used for the installation of the second conductivity members. Therefore, it is possible to increase the number of devices, which can be installed.

It may be arranged that the front surface portion of the device, has a display portion, and the wiring case further comprises an outer wall portion used for fixing the long-scale mount portion to a desired position, and when the device is mounted to the long-scale mount portion, a plane including the display portion of the device and a plane including the outer wall portion make a predetermined inclining angle.

With this structure, it is possible to set the display portion of the device inclined at a desired angle with respect to the outer wall portion of the long-scale mount portion when the device is mounted on the wiring case.

It may be arranged that the front surface portion of the device, has a display portion, and the wiring case has first and second outer wall portions used for fixing the long-scale mount portion to a desired position, and when the device is mounted to the long-scale mount portion, a plane including the display portion of the device, a first plane including the first outer wall portion and a second plane including the second outer wall portion make predetermined inclining angles with respect to each other, and the first plane and the second plane cross with each other on a rear surface side of the mounted device. In this two-wire type wiring case, it may be arranged that the first plane and the second plane cross with each other at right angles.

With this structure, the first outer wall portion and second outer wall portion are fixed to tightly fit the corner portion of the wall where the wiring case is mounted, and thus the wiring case can be mounted to tightly fit with the corner portion. In most of the cases, the corner portion is made at right angles, the first plane and second plane are made orthogonal in a preferable situation.

It may be arranged that the long-scale mount portion has a bent portion for creating a gap between the pair of second conductivity members, and a part of a plane of the bent portion is made in parallel with the first plane.

With this structure, the amount of material used to prepare the long-scale mount portion, can be reduced as compared to the case where the gap is entirely filled with the material which constitutes the long-scale mount portion. Further, when the elasticity of the material is set to an appropriate value, this bent portion becomes to serve as a kind of a spring, thereby making it possible to achieve a cushion-like effect in the wiring case itself while maintaining a sufficient rigidity required as a wiring case.

It may be arranged that the elastic engagement mechanisms are engaged with the fixation mechanisms, when a body of the device is pressed towards the long-scale mount portion, and disengaged from the fixation mechanisms when both side end portions of the device are held by hand so as to deform the device as a whole towards a central line along the longitudinal direction.

With this structure, when the device is held, the engagement mechanisms are released from the fixation mechanisms, thus making it possible to attach or detach the device very easily.

BRIEF DESCRIPTION OF THE DRAWINGS

These objects and other objects and advantages of the present invention will become more apparent upon reading of the following detailed description and the accompanying drawings in which.

DETAILED DESCRIPTION OF THE PREFERRED EMBODIMENTS

A preferred embodiment of the present invention will now be described in detail with reference accompanying drawings. It should be noted that the present embodiment will be explained in connection with the case of a game device which is equipped with the image processing device of the present invention.

In the following description, the present invention will be discussed in connection with a case of a two-wire type wiring case, where the invention is applied in the wiring of a remote control system used for remotely managing commercial products displayed on a product display shelf.

Figure 1:
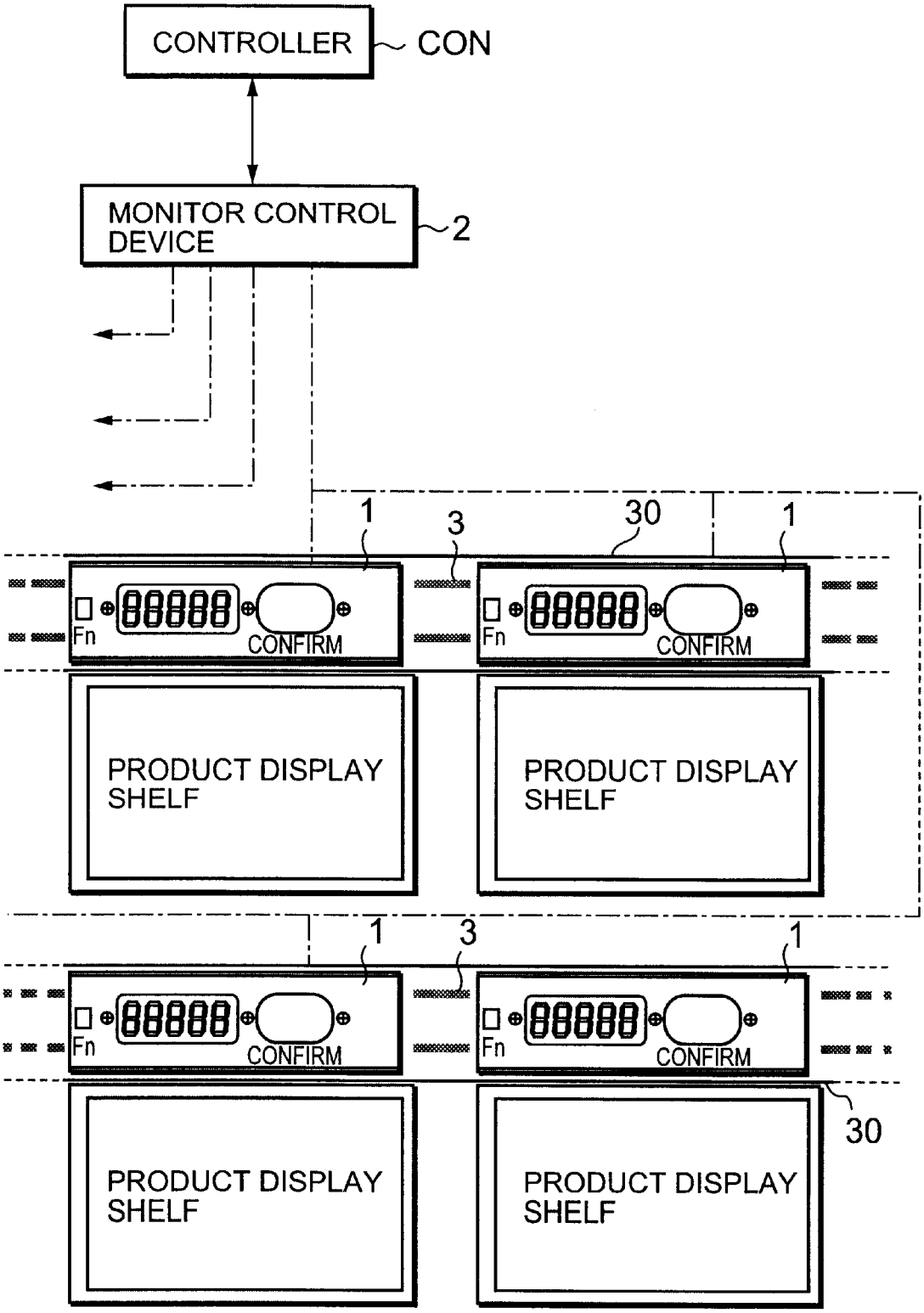
FIG. 1 is a diagram illustrating the entire structure of the case where the two-wire type remote control system according to the present invention is applied to management of commercial products arranged in a product display shelf.

FIG. 1 is a diagram showing an overall structure of a remote control system to which the present invention is applied. In the remote control system, a plurality of display devices 1, each of which is an example of device to be controlled, and a monitor control device 2, which is an example of the control device are provided in such a structure as to establish communications for transmitting/receiving electricity and data between them via two electric power lines 3 (to be called "data and electric transmission/reception communication" hereinafter). To the monitor control device 2, a controller CON for managing the data of commercial products is connected.

The two power lines 3 are arranged to be substantially parallel to each other within a wiring case 30, and they are electrically connected to an electronic part of a display device 1 when the display device 1 is mounted on the wiring case 30.

It should be noted that in FIG. 1, electrical connections between these devices are indicated with chain lines in order to clearly illustrate the connections between these display devices and the monitor control device 2.

The contents of the data and electrical transmission/reception communication s from the monitor control device 2 to the display devices 1 are mainly supply of power and transmission of control data for commands, and related data. On the other hand, the data and electrical transmission/reception communication s from the display devices 1 to the monitor control device 2 are transmissions of execution results of the commands and state data indicating the state of the devices themselves. For the data and electrical transmission/reception communication, addresses one assigned for each of the display devices 1 are used. The communication protocol in the monitor control device 2 is common to all of the display devices 1.

Next, an example of the structure of the display device 1 mounted to the wiring case 30 will now be described.

Figure 2A:
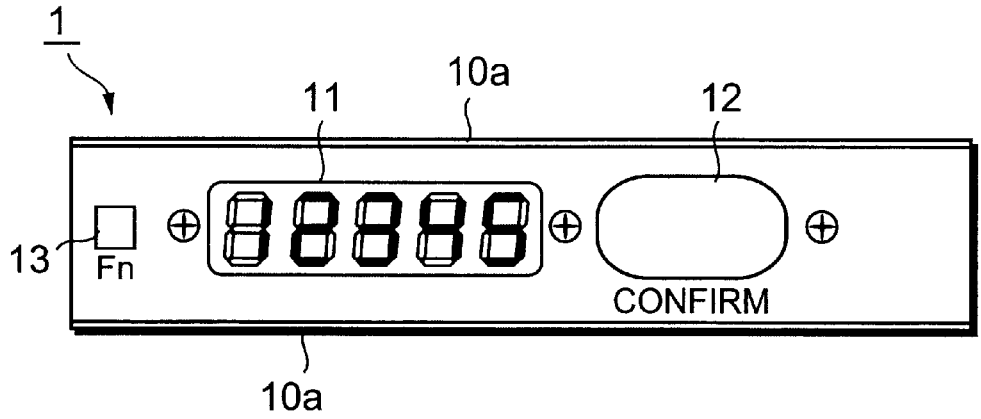
FIGS. 2A to 2B are diagrams illustrating an appearance of the display device of the two-wire type remote control system, FIG. 2A being a front view of the display device 1, FIG. 2B being a side view, FIG. 2C being a rear view, FIG. 2D being a view where the device is observed from the direction indicated by an arrow shown in FIG. 2C, and FIG. 2E being a partially enlarged view of FIG. 2D.
Figure 2B:
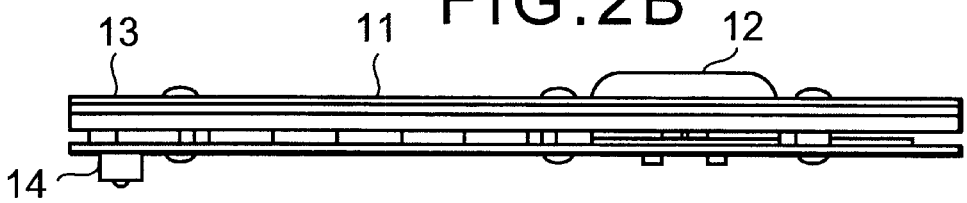
Figure 2C:
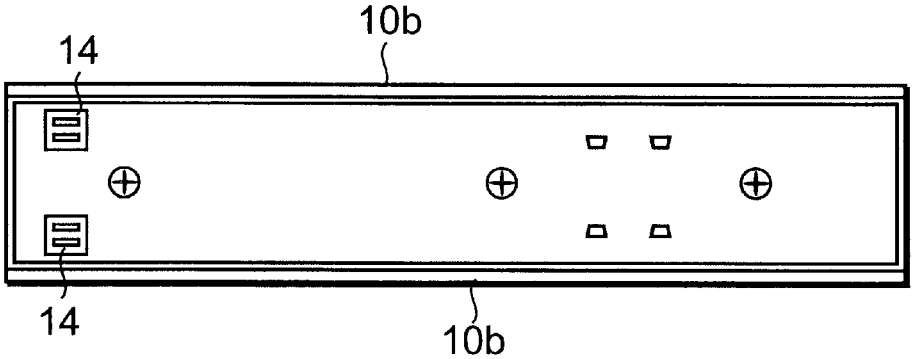
Figure 2D:
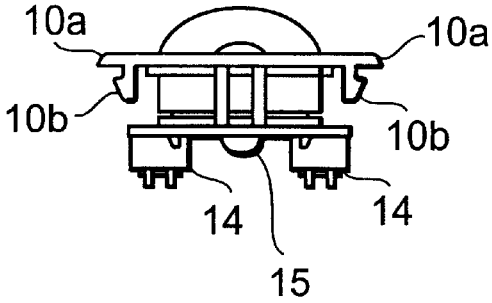
Figure 2E:
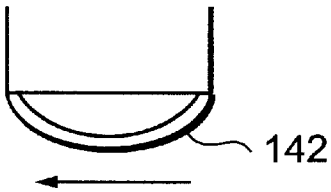

FIG. 2A is a front view of the display device 1, FIG. 2B is a side view, FIG. 2C is a rear view, FIG. 2D is a view where the device is observed from the direction indicated by an arrow shown in FIG. 2C and FIG. 2E is a partially enlarged view of FIG. 2D.

Each of the display devices 1 has a resin-made box having such a shape of rectangle when viewed from its front, which can serve as a cover of the wiring case 30. The box has elastic engagement mechanisms 10*a* and 10*b* formed integrally with the box, at its side end portions in the longitudinal direction thereof. More specifically, at each of end portions of the front side of the box, a taper-shaped holder portion 10*a* is formed so that it can be easily held by the operator. Further, at each of end portions of the rear side of the box, an engagement portion 10*b* is integrally formed to engage with the sidewall of the wiring case 30, which will be later explained. With the elastic engagement mechanisms 10*a* and 10*b*, as a force is applied to the box in the direction of the wiring case 30, the engagement portion 10*b* is engaged with the wiring case 30, whereas as a force is applied in the direction where the holder portion 10*a* is held, the display device 1 can be easily detached from the wiring case 30.

On the surface of the box, a display portion 11 made of a plurality of LEDs for expressing letters, symbols and numerals, a lamp switch 12 for inputting data, and a bottom switch 13 used for canceling an item displayed on the display portion 11, or revising the display contents on the display portion 11 are provided. These switches 12 and 13 are pushed or released so as to output either one of the binary signals to a data processing unit 16, which will be later explained.

On the rear surface of the box, a pair of wiring members 14 are mounted. In this embodiment, a transmission/reception electric communication unit 15, the data processing unit 16 and a display control unit 17 are integrated in one IC, and they will not be illustrated in the figure. Each of the wiring members 14 is designed such that the contact point made at its end portion is brought into contact elastically with the transmission/reception electric communication line 3 when the display device 1 is mounted to the wiring case 30. More specifically, as shown in FIG. 2E, each wiring member 14 and a metal thin plate 142 which is shaped to curve are electrically connected. Further, the metal thin plate 142 serves as the contact point, so as to bring the wiring member 14 into contact elastically with the transmission/reception electric communication line 3 in the wiring case 30. With the above-described structure, each of the power lines of the transmission/reception electric communication line 3 is electrically connected with the contact point of each of the wiring members 14 without fail.

Figure 3:
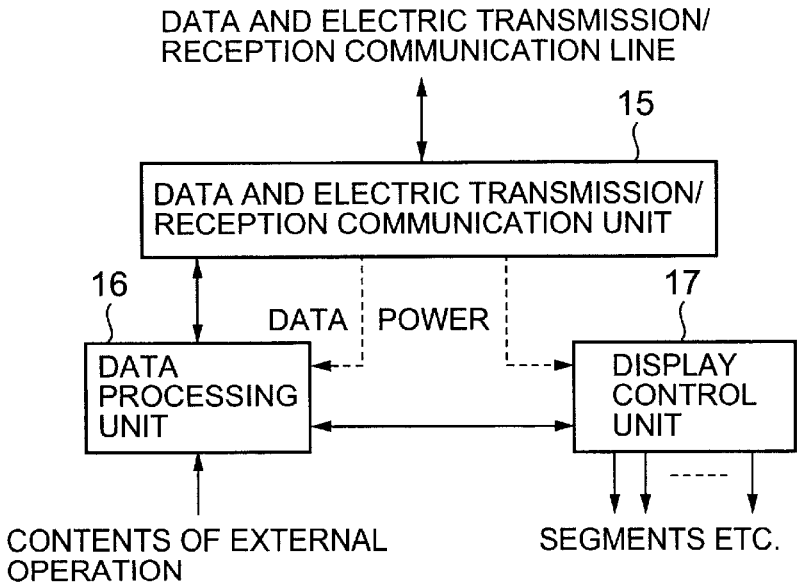
FIG. 3 is a diagram briefly illustrating the functional structure of the display device.
Figure 4:
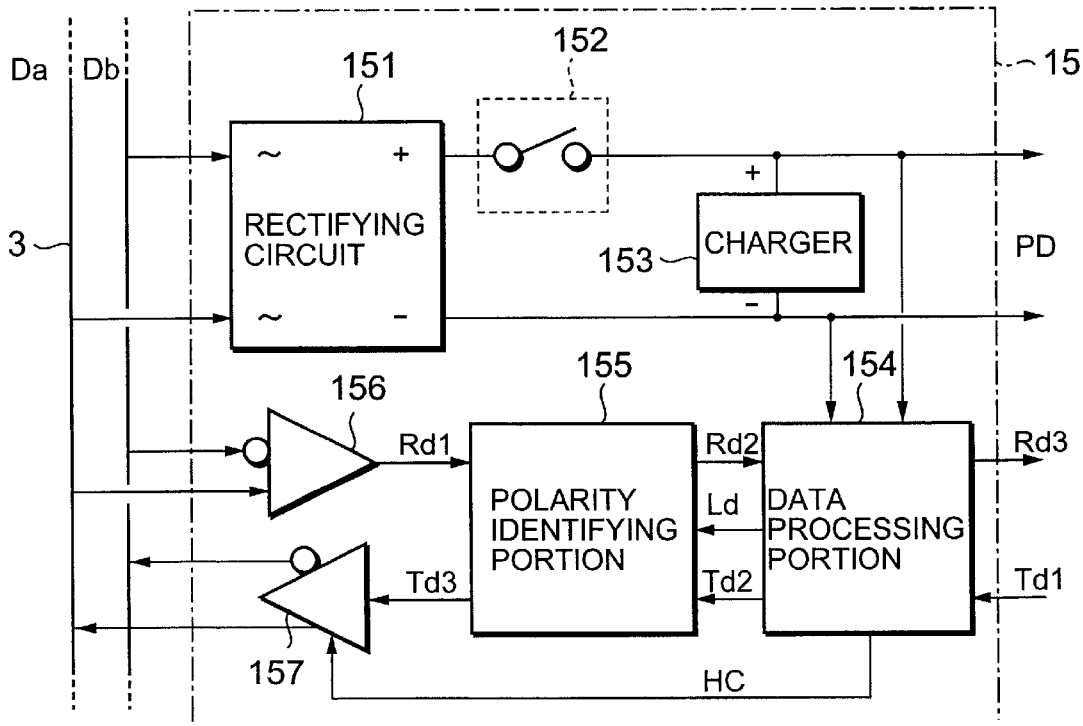
FIG. 4 is a diagram illustrating the transmission/reception electric communication unit of the display device in detail.

The transmission/reception electric communication unit 15, the data processing unit 16 and the display control unit 17 are correlated with each other as can be seen in FIG. 3. The transmission/reception electric communication unit 15 includes, as shown in FIG. 4, a rectifying circuit 151 for converting powers Da and Db received via the power line 3, into DC powers (voltage) by bridge rectification, a voltage comparing portion 152 for judging whether or not a rectified voltage is equal to or higher than a predetermined voltage value Vdd (<Vcc), a storage unit 153 for storing the electricity when the rectified voltage is Vdd or higher, a reception buffer 156 for converting level inversion data of an equilibrium pulse-like power received via the power line 3 into logical data Rd 1 which is a combination of logic "1" and logic "0", a polarity determination portion 155 for determining a power level on the power line 3 on the basis of the logical data Rd1 sent from the reception buffer 156 so as to unify the initial logic level recognized by the transmission/reception electric communication unit 15, at logic "1" (or logic "0"), and a data processing portion 154 for generating data for identifying the self device (self device address) and pulse group data indicating the data contents addressed to the monitor control device 1, and for executing a desired data process. The data processing portion 154 is established in such a structure that a program code recorded in a memory region (not shown) is read and executed by the CPU (omitted from the figure) of the main device, and it executes a data comparison process for detecting the address to the self device and electricity reception stopper data, that is, delimiter (data transmission end signal), from the logic data Rd1 converted by the reception buffer 156, and a process for generating a control signal used when a stored power is taken in from the storage device 153 upon detection of one of the above-mentioned data, and the power is transmitted via the transmission/reception electric communication line 3.

Further, the communication unit 15 includes a transmission buffer 157 for controlling the power supply to the power line 3 on the basis of the control signal and a signal Td3 outputted from the polarity determining portion 155.

The storage power PD stored in the storage device 153 is sent to the data processing unit 16 serving as a complement to the data processing portion 154, and to the display control unit 17 for controlling the display portion 11. Further, the contents of the display control can be determined on the basis of data Rd3 outputted from the data processing unit 154, or the contents of the operation performed by the operator can be inputted to the data processing portion 154 to be transmitted to the monitor control device 2.

Figure 5:
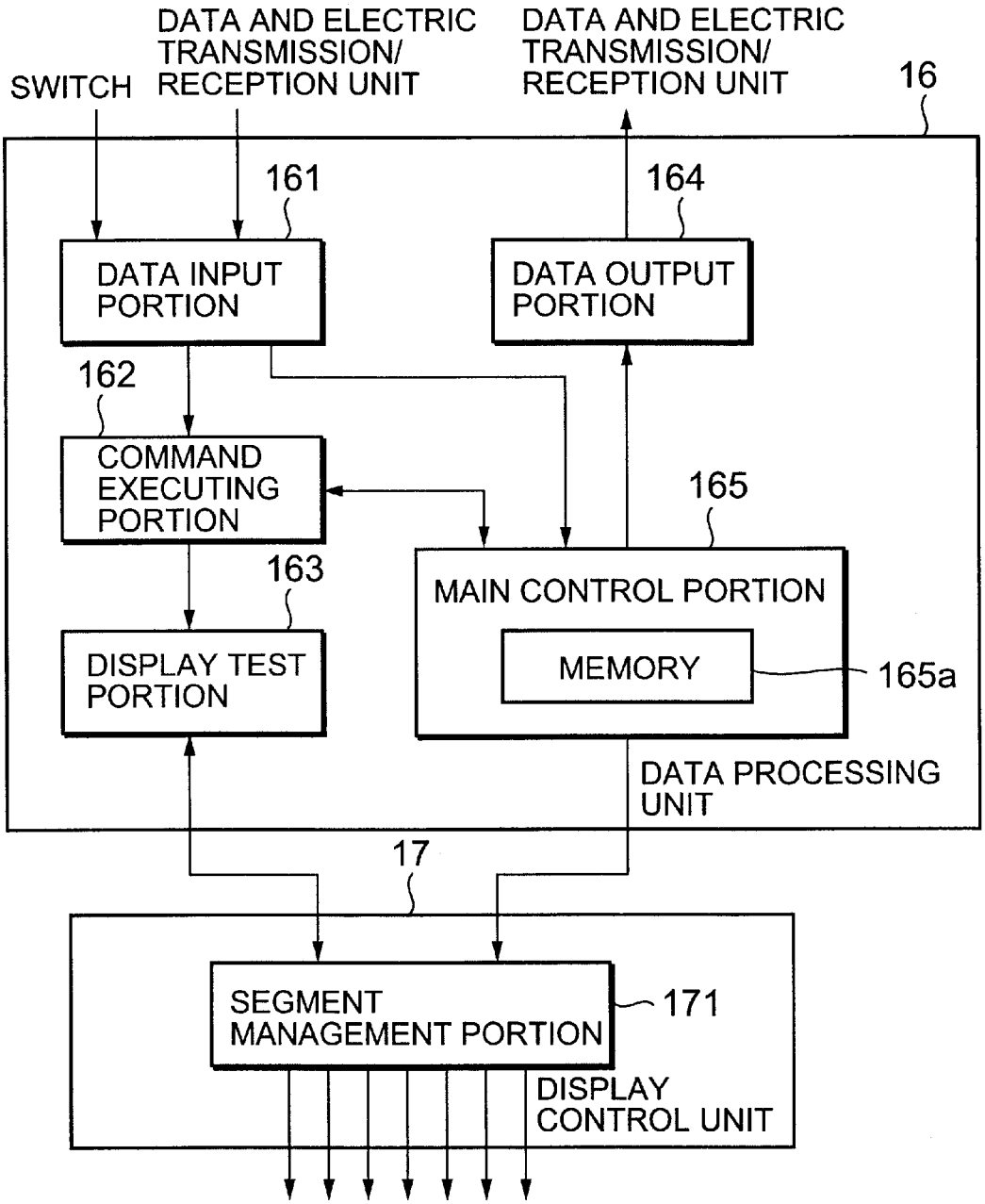
FIG. 5 is a diagram briefly illustrating the structure of the monitor control device.

Next, the monitor control device 2 will now be described. The monitor control device 2, as shown in FIG. 5, includes, at least, a power source for outputting a DC power (voltage value) Vcc, a switch group (Sa1 to Sa4) 21 regulating electrical connection between the current power Vcc and the data and electrical transmission/reception communication line 3, a power control portion 22 for controlling open/close of the switch group 21, a data processing portion 23 for generating pulse group data containing designated address of the display device 1 and instruction data addressed to the display device 1, and a reception buffer 24 for converting the power level of the data and electrical transmission/reception communication line 3 into logical data so as to introduce it to the data processing portion 23. The data processing portion 23 also carries out data transfer between itself and some other external device via an external input/output terminal (not shown). The switch group 21 and the power control portion 22 constitute power control means of the supplier side.

It should be noted that although omitted from the illustration of the figure, the monitor control device 2 has an input output port to enable input of n-bit data from the display device 1, and output of m-bit data to the display device 1.

<Two-line Type Transmission/reception Electrical Communication>

Next, two-wire type data and electrical transmission/reception communication s carried out between the display device 1 and the monitor control device 2 will now be briefly described.

Figure 6:
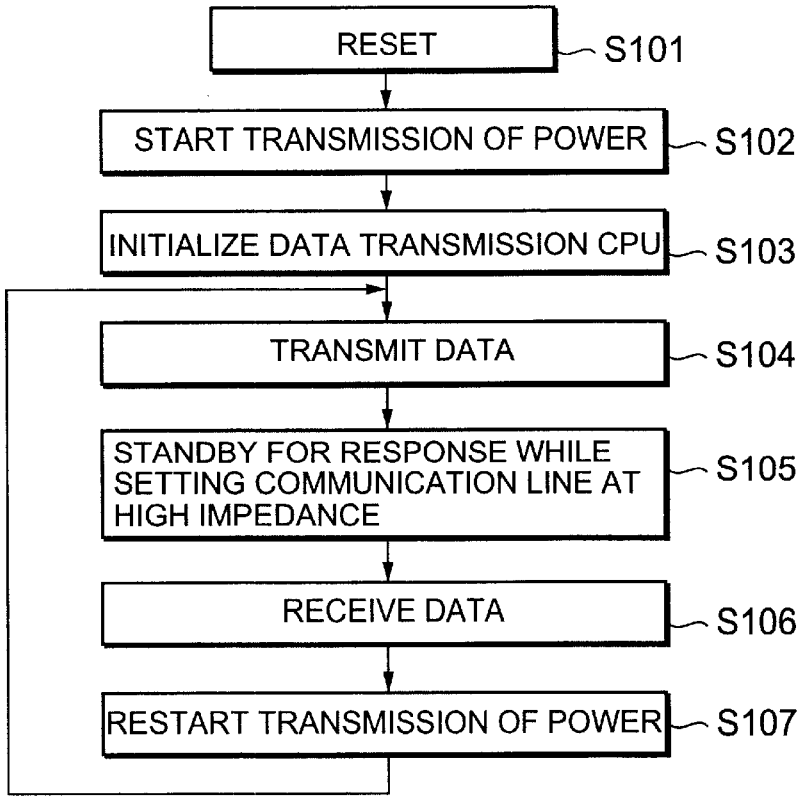
FIG. 6 is a diagram illustrating the processing procedure on the monitor control device side when a data and electrical transmission/reception communication is conducted.
Figure 7:
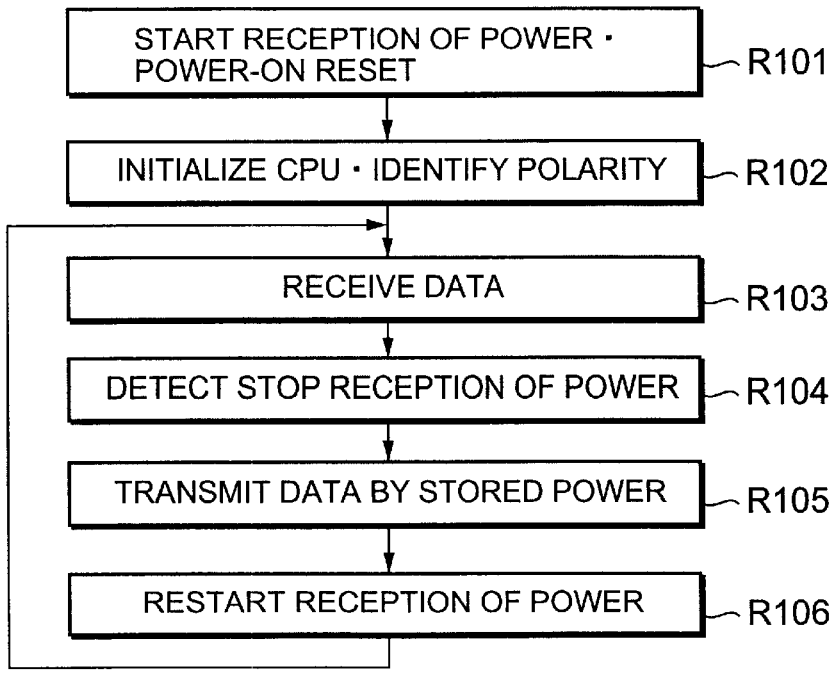
FIG. 7 is a diagram illustrating the processing procedure on the display device side when a data and electrical transmission/reception communication is conducted.

FIG. 6 is a diagram illustrating the processing procedure on the side of the monitor control device 2, and FIG. 7 is a diagram illustrating the processing procedure on the side of the display device 2.

(Monitor Control Device to Display Device):

On the side of the monitor control device 2, as shown in FIG. 6, the electricity supply start process (S102) is executed upon power-ON reset (S101), and the transmission CPU (hardware which establishes the data processing portion 23) is initiated (S103), thus sending to-be-transmitted data Tds to the power control portion 22. The data Tds is pulse group data made of a combination of High level (logic "1") and Low level (logic "0"). The specific contents of the pulse group data are assigned addresses of a header (H), commands (such as reset, signal output, input disable/enable, control start, data acquisition, control stop, address setting and switch function setting), and a subject display device 1), assigned contents (lighting numerals, blinking switch, etc.) and delimiter (DM).

The power control portion 22 controls the switch group (Sa1 to Sa4) 21 by setting them ON/OFF in accordance with the pulse group data. Here, the switches Sa1 and Sa2 are controlled to be OFF, and then the switches Sb1 and Sb2 are turned ON with delay time of t. As a result, an equilibrium pulse-like power based on the current power Vcc is supplied to the transmission/reception electric communication line 3. In the equilibrium pulse power, an interval of time t is created when the power is inverted. Therefore, it is possible to prevent short-circuiting, or generation of noise due to a harmonic component.

On the side of the display device 1, as shown in FIG. 7, when the equilibrium pulse powers (Da and Db) are supplied from the monitor control device 2, the reception of the electricity from the power lines 3 is started, and on the basis of the electrical power, the power-ON reset is executed (R101). Then, the CPU (hardware for establishing the data processing portion 154) is initiated. Further, the logical data (logic "1"/logic "0") Rd1 contained in the equilibrium pulse power is detected by the reception buffer 156. Then, based on the logical data, the polarity is determined and set by the polarity determining portion 155 (R102). After that, the reception of the data from the monitor control device 1 is continued for a time period of ta (R103).

(Display Device to Monitor Control Device)

The monitor control device 2, after the transmission of the data Tds, sets the impedance between itself and the transmission/reception electric communication line 3 to a high impedance, and stands by for a reply from the display device 1 (FIG. 6: S105). To be specific, in the high impedance control, those switches of the switch group 21 are set in an open state (OFF state) by means of the power control portion 22, so as to cut the electrical supply of the DC power Vcc.

The display device 1, when detecting stop receiving electricity, that is, when the voltage comparing circuit 152 outputs a voltage drop signal SP (R104), the storage power of a peak value of Vdd, stored in the storage device 153 is used to transmit data (R105). More specifically, pulse group data Td2 is generated on the basis of the status data addressed to the monitor control device 2, and the data is converted by the polarity determining portion 156 into polarity-set data Td3 (that is data set to the polarity on the transmission/reception electric communication line, which is known at the start of the operation), to be guided to the transmission buffer 17. At the same time, a control signal HC is transmitted to the transmission buffer 157 in order to activate the transmission buffer 157, and an equilibrium pulse power of an amplitude of Vdd is supplied to the transmission/reception electric communication line 3. The generation process of the equilibrium pulse power is substantially the same as that of the case of the monitor control device 2; however in this example, it is carried out within the data processing portion 154.

The specific contents of data to be transmitted, that is, the pulse group data generated in the data processing portion 154, are a header (H), the address of the self device, status data and delimiter (DM). The status data includes a reply from the monitor control device 2 on the basis of the assigned contents, the notification of the status of the self device, and others.

After transmission of the data, that is, after the supply of the equilibrium pulse power, the reception of electricity is re-started (R106).

On the other hand, the monitor control device 2 is under the high impedance control, and set in such a status capable of receiving an equilibrium pulse power from the transmission/reception electric communication line 3. When an equilibrium pulse power is received, the power is converted into pulse group data Rds by the reception buffer 24, and then sent to the data processing portion 23 (FIG. 6: S106). The data processing portion 23 decodes the contents of the pulse group data Rds, and sends the result to the controller CON. After finishing the data transmission, the supply of electricity is re-started (S 107).

<Wiring Case>

Next, the wiring case 30 of the embodiment will now be described.

Figure 8A:
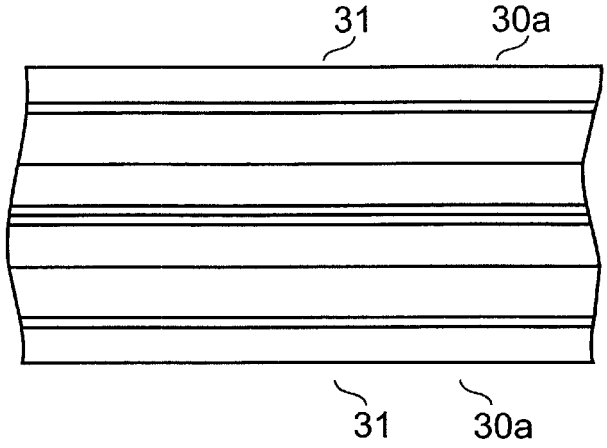
FIGS. 8A to 8D are diagrams illustrating an appearance of the wiring case, FIG. 8A illustrating a top view, FIG. 8B illustrating a side view, FIG. 8C illustrating a front view in cross section, and FIG. 8D illustrating a front view in cross section, when the display device is mounted.
Figure 8B:
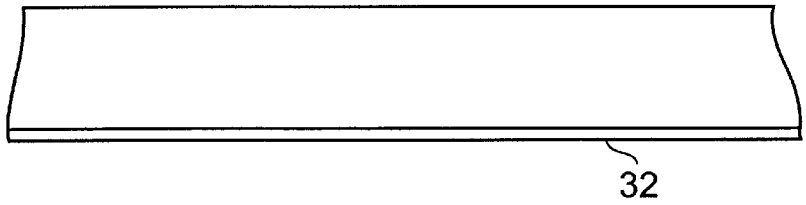
Figure 8C:
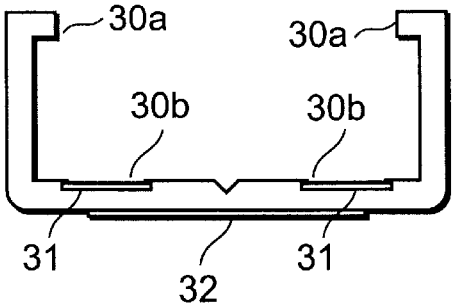
Figure 8D:
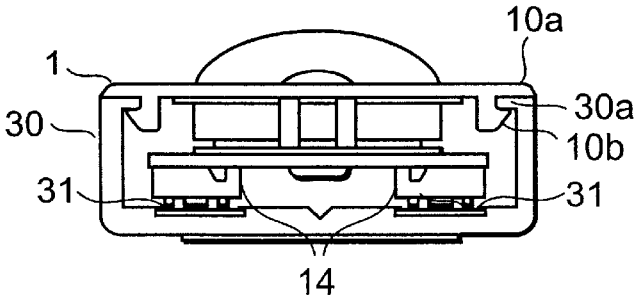

FIGS. 8A to 8D illustrate an example of the structure of the wiring case, FIG. 8A illustrating a top view, FIG. 8B illustrating a side view, FIG. 8C illustrating a front view in cross section, and FIG. 8D illustrating a front view in cross section, when the display device 1 is mounted.

The wiring case 30 shown in FIG. 8 can be detachably mounted to the display device 1 which can carry out data and electrical transmission/ reception communication s with a predetermined control device via two power lines. In this example, the wiring case 30 is prepared by forming a resin-made long box having a cross section of a U shape. In an inner side of the bottom surface portion of the case, two conductive plates 31 are arranged side by side, in this example, to be parallel with each other. The data and electrical transmission/reception communication lines 30 in the wiring case 30 are made of these conductive plates 31.

In the display device 1, as shown in FIGS. 2 and 8D, a pair of wiring members 14 which can be connected to one of the two power lines only by mounting it to the wiring case 30 are prepared so as to facilitate the connection with the power lines. The tip end portion of each of the wiring members 14 is directed to the bottom surface portion of the wiring case 30, and a contact point 142 is provided in the tip end portion. The height of each of the wiring portion 14 and the height of the wiring case 30 in which the wiring portions 14 are housed are set to the height where the contact point 142 of each wiring portion 14 is brought into contact elastically with one power line.

The wiring case 30 has an open section on an opposite side to its bottom surface portion, and a stopper portion 30*a* is formed at an end of a sidewall of the long box. Each of the stopper portion 30*a* is designed to stop the engagement portion 10*b* of the display device 1, and it is formed at an end portion of a sidewall of the long box, not on the bottom surface portion of the long box. With the above-described structure, the entire area of the bottom surface portion created between one side in the longitudinal direction and the other side, can be used for the installation of the conductive plates 31. As compared to the structure in which the stopper portions 30*a* are provided on the bottom surface portion, the width of each conductive plate 31 and the distance between conductive plates 31 can be expanded further.

As a result, the conductive plates 31 can be elongated or enlarged. Here, since the conductivity of a conductive plate 31 is determined by its cross sectional area, as the conductivity is increased, the voltage drop is decreased. This means that a greater number of display devices 1 can be mounted in the same wiring case 30, or that the DC power applied to a conductive plate 31 can be decreased, or that the distance between conductive plates 31 can be expanded, thus making it possible to prevent the interference between them. For this reason, in this embodiment, the bottom surface portion of the wiring case 30 is formed to be planar so that the area of the bottom surface can be made as large as possible. Further, the wiring case 30 is fixed to a desired position by means of an adhesion layer 32.

In order to detach each display device 1 from the stopper portions 30*a* formed on the wiring case 30, the display device 1 is pulled in the direction away from the wiring case while holding the holder portions 10 formed on both side of the display device 1.

As described above, the box of the display device 1 is made of resin. Therefore, when the holder portions 10*a* on the both sides are held, the shape of the display device is deformed towards the central line along the longitudinal direction. In this manner, each of the stopper portions 10*b* is moved in the direction in which the engagement state with the respective stopper 30*a* is released, and thus the display device can be easily removed from the wiring case 30.

Further, with the structure in which the box of the wiring case 30 is made of resin, and its sidewall has a certain height, the case has a flexibility as compared to the case where there is no sidewall. Therefore, even in the case where the engagement state between the engagement portions 10*b* and the stopper portions 30*a* is not completely released, as the stopper portions 10*b* and stopper portions 30*a* are bent to make it easier to release the engagement state.

Next, a wiring case 40 according to another embodiment will now be described.

Figure 9A:
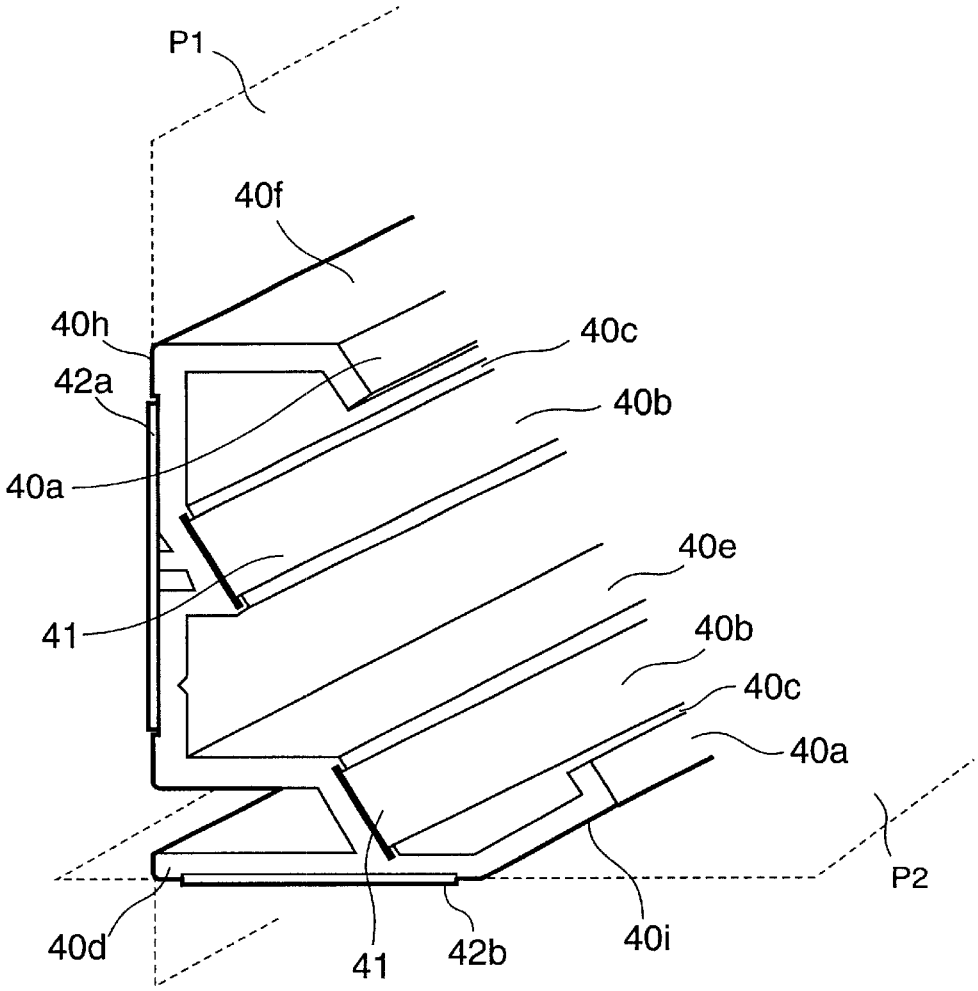
FIGS. 9A and 9B are diagrams illustrating an appearance of the wiring case according to another embodiment, FIG. 9A illustrating a perspective view, and FIG. 9B illustrating a front view in cross section, when the display device is mounted.
Figure 9B:
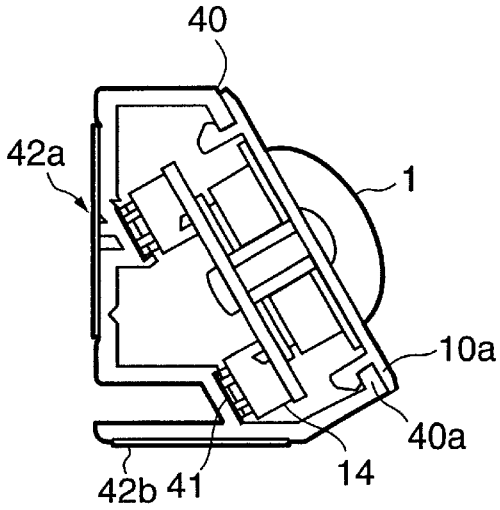

FIGS. 9A and 9B illustrate an example of the structure of the wiring case, FIG. 9A illustrating a perspective view, and FIG. 9B illustrating a front view in cross section, when the display device 1 is mounted. The display device 1 is the same as one shown in FIG. 8.

In the wiring case 40, the thickness of the resin material at each section of the long box is substantially the same. In this example, a bent portion 40*g* is formed between two conductive plates 41, and a recess portion 40*e* is formed between the conductive plates. The conductive plates 41 are arranged side by side on conductive plate support portions 40*b* provided on the same plane, and in this example, to be in parallel with each other. Data and electric transmission/ reception communication lines 30 in the wiring case 40 are constituted by these conductive plates 41.

A portion opposite to each conductive plate support portion 40*b* is opened, and a stopper portion 40*a* is formed on each of an end of a first side wall 40*h* extending from one of the conductive plate support portions 40*b*, and an end of a second side wall 40*i* extending from the other of the conductive support portions 40*b*. Each of the stopper portions 40*a* is designed to engage and stop the engagement portion 10*b* of the display device 1. The detachment of the display device 1 from the stopper portions 40*a* formed in the wiring case 40 is done by holding the holder portions 10*a* as in the example shown in FIG. 6.

In this example, the stopper portion 40*a* is formed not on the conductive plate support portion 40*b*, but on each of the end of the first sidewall 40*h* and the end of the second sidewall 40*i*. With this structure, the entire area of each conductive plate support portion 40*b* can be used for the installation of the conductive plates 41. It should be noted here that in this example, the conductive plates 41 are not provided in a region indicated by reference numeral 40*c* in the conductive plate support portion 40*b*; however it is naturally possible to suppress the voltage drop by the conductive plate 41 by expanding the conductive plate 41 even to the region 40*c*.

With the above-described structure, the width of each conductive plate 41 and the distance between the conductive plates 41 can be expanded further as compared to the case where the stopper portion 40*a* is provided for the conductive plate support portion 40*b*. Since the length or size of each conductive plate 41 can be increased, a greater number of display devices 1 can be mounted on the same wiring case 41 as in the example shown in FIG. 6.

The long box has a first outer wall portion and a second outer wall portion, which are both inclined with respect to the plane including display portion 11 mounted on the surface portion of a display device 1 when the display device 1 is installed.

The first outer wall portion is formed along a plane P1 having a first inclined angle with respect to the main plain, and it is constituted by a part of a first side surface 40*h* and a part of the bent portion 40*e*. The second outer wall portion is formed along a plane P2 having a second inclined angle with respect to the main plain, and it is constituted by a projecting portion 40*d* extending from the above-described conductive plate support portion 40*b*. In this example, the plane P1 which makes the first inclined surface and the plane P2 which makes the second inclined surface cross normally on the rear surface side of the display device 1.

With the above-described structure, after assuring such a rigidity that is required for the wiring case 40, an S-letter shape is formed with the bend portion 40*e*, the other one of the conductive support portion 40*b*, and the projecting portion 40*d*. With this shape, when the elasticity (flexibility) of the resin itself which constitutes the wiring case 40 is selected to be an appropriate value, it becomes possible to impart an elasticity to the entire wiring case 40, and therefore to obtained a cushion-like effect in the wiring case 30 itself.

Further, by means of an adhesion layer 42*a* formed on the first outer wall portion and an adhesion layer 42*b* formed on the second outer portion, the wiring case 40 is fixed to a desired position such as a corner site.

In this example, the first outer wall portion and the second outer wall portion normally cross with each other, and therefore the case can be adhered and fixed to just fit at a corner portion where the two walls cross at an angle of 90 degrees. Further, in the case where the wiring case 40 has such a cushion-like effect as described above, even if the angle made by the first and second outer wall portions, and the angle of the corner section do not necessarily perfectly coincide with each other, the wiring case 30 can be adhered and fixed at the corner without rattling due to the above-described cushion-like effect provided that the difference between these angles is sufficiently small.

As described above, the stopper mechanisms are formed at side end portions of the long box of the wiring case so that they can be arranged at sites as distant as possible from the conductive members. With this structure, the width of each conductive plate and the distance between conductive plates can be increased as compared to the case where such a stopper mechanism is located near the conductive members. As the width of each conductive plate can be increased, the conductivity of the plate is increased, thereby suppressing the voltage drop. Therefore, there can be a greater number of devices to be controlled, provided in one case.

Various embodiments and changes may be made thereunto without departing from the broad spirit and scope of the invention. The above-described embodiment is intended to illustrate the present invention, not to limit the scope of the present invention. The scope of the present invention is shown by the attached claims rather than the embodiment. Various modifications made within the meaning of an equivalent of the claims of the invention and within the claims are to be regarded to be in the scope of the present invention.

What is claimed is:

1. A two-wire type wiring case for mounting a device to be controlled, which establishes data and electric transmission/reception communication with a predetermined controller, the device having a front surface portion provided thereon with an electronic circuit operable by the data and electric transmission/reception communication, side portions provided thereon with respective elastic engagement mechanisms, and a rear surface provided thereon with a pair of projecting portions each having at a tip end thereof a first conductivity member electrically connected to the electronic circuit, the wiring case comprising:

a long-scale mount portion for detachably mounting the device, the long-scale mount portion comprising:

a pair of second conductivity members provided in a band-like arrangement in a longitudinal direction at positions which are respectively contactable with the pair of first conductivity members, the pair of second conductivity members having a gap provided therebetween for avoiding an interference of one of the second conductivity members, the interference being otherwise caused due to power flowing through the other of the second conductivity members when the pair of second conductivity members are energized; and fixation mechanisms provided at positions remote from the pair of second conductivity members, for detachably fixing the device, by engaging with the respective elastic engagement mechanisms, wherein the pair of first conductivity members are brought into contact with the second conductivity members respectively when the device is mounted onto the wiring case so that data and electric transmission/reception communication between the mounted device and the controller is established when the second conductivity members are electrically connected to the controller.

2. A two-wire type wiring case according to claim 1, wherein the long-scale mount portion has a shape of substantially U in a cross section perpendicular to the longitudinal direction, and the pair of second conductivity members are provided on an inner bottom surface of the long-scale mount portion.

3. A two-wire type wiring case according to claim 1, wherein the front surface portion of the device, has a display portion, and the wiring case further comprises an outer wall portion used for fixing the long-scale mount portion to a desired position, and when the device is mounted to the long-scale mount portion, a plane including the display portion of the device and a plane including the outer wall portion make a predetermined inclining angle.

4. A two-wire type wiring case according to claim 1, wherein the front surface portion of the device, has a display portion, and the wiring case has first and second outer wall portions used for fixing the long-scale mount portion to a desired position, and when the device is mounted to the long-scale mount portion, a plane including the display portion of the device, a first plane including the first outer wall portion and a second plane including the second outer wall portion make predetermined inclining angles with respect to each other, and the first plane and the second plane cross with each other on a rear surface side of the mounted device.

5. A two-wire type wiring case according to claim 4, wherein the first plane and the second plane cross with each other at right angles.

6. A two-wire type wiring case according to claim 4, wherein the long-scale mount portion has a bent portion for creating a gap between the pair of second conductivity members, and a part of a plane of the bent portion is made in parallel with the first plane.

7. A two-wire type wiring case according to claim 4, wherein the elastic engagement mechanisms are engaged with the fixation mechanisms, when a body of the device is pressed towards the long-scale mount portion, and disengaged from the fixation mechanisms when both side end portions of the device are held by hand so as to deform the device as a whole towards a central line along the longitudinal direction.

* * * * *